US005351927A

United States Patent [19]

Howell

[11] Patent Number: 5,351,927

[45] Date of Patent: Oct. 4, 1994

[54] BOOK HOLDER FOR USE WITH STAND ASSEMBLIES

[76] Inventor: Richard J. Howell, 209 Dewey Hill Rd., Stowe, Vt. 05672

[21] Appl. No.: 986,458

[22] Filed: Dec. 7, 1992

[51] Int. Cl.[5] ..... A47B 5/00

[52] U.S. Cl. ..... 248/444.1; 248/451; 248/445; 248/316.4; 16/18 R

[58] Field of Search ..... 248/444.1, 445, 451, 248/441.1, 121, 122, 176, 316.4, 231.4, 188.9, 188.8, 447; 400/718; 16/29, 30, 18 R

[56] References Cited

U.S. PATENT DOCUMENTS

| | | | |
|---|---|---|---|
| 363,047 | 5/1887 | Claughton | 16/18 R |
| 1,041,101 | 10/1912 | Kobzy | 248/447 |
| 1,483,396 | 2/1924 | Terrell | 248/451 |
| 2,193,907 | 3/1940 | Love | 248/445 |
| 3,213,482 | 10/1965 | Butsch | 16/18 R |
| 3,790,770 | 2/1974 | Stern | 248/445 |
| 3,981,522 | 9/1976 | Bloom | 248/451 X |
| 4,496,126 | 1/1985 | Melton et al. | 248/451 X |
| 4,553,728 | 11/1985 | Corsello | 248/444.1 X |
| 5,058,848 | 10/1991 | Ferraro | 248/444.1 |
| 5,072,909 | 12/1991 | Huang | 248/316.1 X |

FOREIGN PATENT DOCUMENTS

| | | | |
|---|---|---|---|
| 3903543 | 3/1990 | Fed. Rep. of Germany | 248/445 |
| 2224979 | 10/1974 | France | 248/441.1 |

*Primary Examiner*—Karen J. Chotkowski
*Attorney, Agent, or Firm*—Paul M. Craig, Jr.

[57] ABSTRACT

A book holder with a back plate, a transparent cover plate movable relative to the back plate, and a connection between the back plate and the cover plate which permits the cover plate to move relative to the back plate so as to provide guided movement of the cover plate toward and away from the back plate in substantially co-planar relationship, whereby lateral support arms are fixed relative to the cover plate, hollow receiver plates are fixed relative to the back plate and the hollow receiver plates are of such internal configuration as to enable the lateral support arms to slide therethrough.

35 Claims, 7 Drawing Sheets

BOOK HOLDER FOR USE WITH STAND ASSEMBLIES

FIELD OF INVENTION

The present invention relates to a book holder which can be attached to several types of optional stands and which permits hands-free reading and which allows ergonomically easy, hand-assisted page turning in a wide variety of easy-to-read positions.

BACKGROUND OF THE INVENTION

Book holders to facilitate reading have been proposed in the prior art for many years in numerous shapes and configurations. The following are typical prior art patents dealing with this subject: U.S. Pat. Nos. 376,593 to Greenawait et al., 1,083,764 to Smith, 1,692,337 to Forbes, 190,12,267 to Fitzsimmons, 2,422,877 to Anderson, 2,546,283 to Webster, 2,612,721 to Pollard 2,807,908 to Lykes, 3,740,015 to Adams, 3,809,352 to Mathias, 3,905,573 to Davis, 3,981,522 to Bloom, 4,116,413 to Andersen, 4,313,589 to Vega, 4,378,102 to Portis, Jr. et al., 4,465,255 to Hill, 4,496,126 to Melton et al. and 4,596,372 to Ford. A book holder which has been commercially available in the recent past is described in U.S. Pat. No. 4,702,453 to Bishop. However, all the prior art book holders entail disadvantages as regards difficulty in use, particularly also in turning book pages and obstruction of the reading material by rods, strings, wires, segmented plastic flaps, etc., while others are not readily adaptable to wide ranges of sizes of books.

SUMMARY OF THE INVENTION

It is a principal object of the present invention to provide a book holder which is simple in construction, easy to use and is able to secure hard cover books or paperbacks in a wide variety of easy-to-read positions, where the reader is reclined or seated with the head positioned upright or reclined.

Another object of the present invention resides in a book holder which permits hands-free holding of the book while reading and allows the book to be held in nearly any position relative to the reader's body.

Still another object of this invention is to hold flat the pages of the book without obstructing the reader's view of the text.

A further object of the present invention resides in a book holder which offers easy page turning.

Another object of the present invention is to hold the pages flat, allow easy page turning, and yet not having to make major adjustments to the device to hold different size books.

A still further object of the present invention resides in its modular adaptability to several different types of stands for the book holder which offer great versatility of adjustments to different types of use (home in chairs, home or hospitals in bed, home or commercial kitchen counters, office, floor) by easy means, represents an aesthetically pleasing article of furniture, is easy to assemble and disassemble and consists of components readily connected by screws.

The present invention solves the problems encountered with the prior art constructions by providing a transparent cover plate which is movable relative to a fixed back plate onto which the book is fastened whereby support arms on both sides of the transparent cover plate are adapted to engage in receiver plates along the sides of the back plate to guide the movement of the cover plate toward and away from the back plate. A unique mechanism utilizing a toothed configuration along one edge of the support arms in conjunction with a receiver plate having a catch at the inlet opening which cooperates with the teeth at the support arms provides for easy adjustment of the cover plate. Cam areas may be provided in one embodiment of the invention at the bottom and top of the exit area of the receiver plate to permit a smooth-sliding, fulcrumed movement of the support arm for purposes of latching and unlatching the latter in relation to the receiver plate. Several different types of stands for the book holder can be used with this invention. One type of stand thereby conventionally includes a base, a lower upright post and an upper upright post adjustable relative to one another which are fixedly supported on the base, and a lateral post rotatably mounted at the upper post member and pivotally secured to the back plate of the book holder for universal movement. The base of the stand of a preferred embodiment of this invention is formed of a two-legged base member and of a single leg base member extending at right angle to the double two-legged base member from the center area thereof whereby the caster support members are substantially L-shaped with the shorter vertically disposed leg portions thereof serving to hold the casters while the longer, substantially horizontally disposed leg portions are fastened within the free ends of the base members. The book holder and stand therefor in accordance with the present invention provide an aesthetically appealing furniture item, the component parts of which can be manufactured for shipment in broken-down condition for subsequent easy assembly by the user. By utilizing wood as the material for the component parts, such as ash wood for strength, maple for cost, beech, etc., the book holder of this invention constitutes an attractive piece of furniture.

A unique device is used to hold the casters to the stand, allowing the legs of the stand to be very low in their vertical profile, thus allowing the legs to slip under the small openings of couches and reclining furniture, so that the book holder can be positioned for ergonomic reading.

Other types of stands can also be used, such stands including two or more rectilinear or curved arms connected with each other by universal joints, supported on a table to which the end of the arm opposite the book holder is secured, for example, by clamping. Another stand which excels in low cost and convenience may consist of an approximately U-shaped one-piece torso member of thermo-formed plastic material which can be placed about the upper body of the reader who can then read on the floor, on a mattress, fouton, etc. The torso member is provided with receiver plates or a curved receiver plate that is molded-in or added on to cooperate with the support arms of the book holder.

BRIEF DESCRIPTION OF THE DRAWINGS

These and other objects, features and advantages of the present invention will become more apparent from the following description when taken in connection with the accompanying drawing which shows, for purposes of illustration only, several embodiments in accordance with the present invention, and wherein.

DETAILED DESCRIPTION OF THE DRAWINGS

Figure 1:
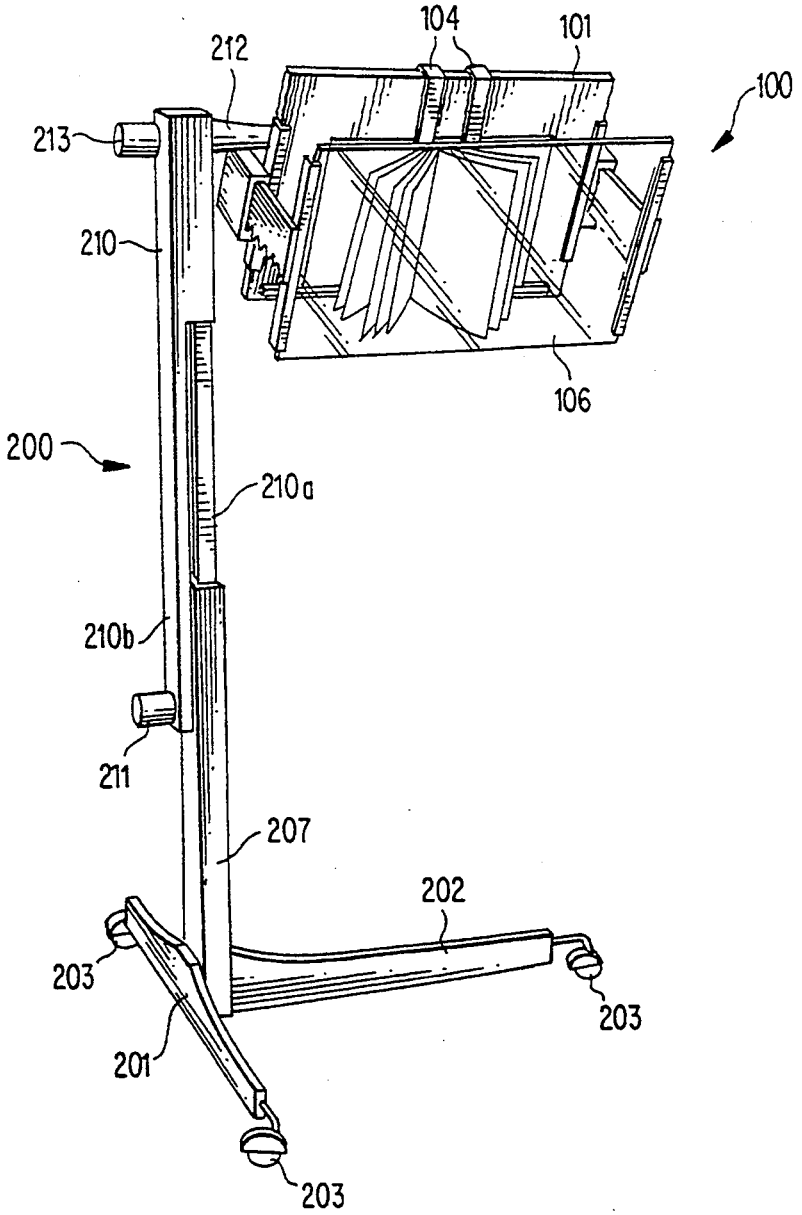
FIG. 1 is a somewhat schematic perspective view of a book holder and stand assembly in accordance with the present invention.
Figure 7:
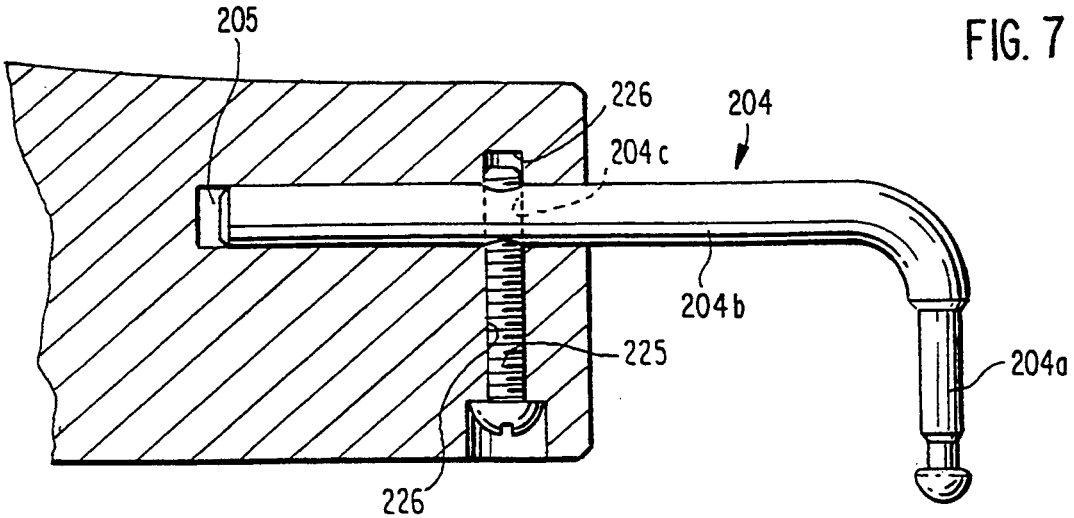
FIG. 7 is an elevational view of a caster support in accordance with the present invention, illustrating also how it is secured in a horizontal bore at the end of a base member.

Referring now to the drawing wherein like reference numerals are used throughout the various views and more particularly to FIG. 1, the book holder in accordance with the present invention is generally designated by reference numeral 100 and one, optional, frame-like stand of any known construction for the book holder by reference numeral 200. The base of a typical, known frame-like stand 200 includes a two-legged base member 201 and a one-legged base member 202 which extends at right angle to the two-legged base member 201. Casters 203 of any conventional low-profile construction are mounted in accordance with this invention in horizontal bores 205 at the end faces of the base members 201, 202 by means of unique caster supports generally designated by reference numeral 204 which consist of a shorter leg portion 204*a* (FIG. 7) on which is pivotally mounted the caster and of a longer leg portion 204*b* which is mounted horizontally into a corresponding bore 205 in the free end of the respective base member. In case the base members 201 and 202 are made of wood, that part of the corresponding base member which is below the horizontal bore 205, is prevented from splitting by a threaded member 225 screwed into the bore 226 of the corresponding base member from the bottom face thereof. The bore 226 thereby extends at substantially right angle to the horizontal bore 205 and slightly above the same so that the threaded member 225 at the same time can axially fix the longer leg portion 204*b* within the bore 205 by extending through and beyond the bore 204*c* provided in the longer leg portion 204*a*, as shown in FIG. 7. The single-legged base member 202 is threadably fastened to the two-legged base member 201 in a conventional manner (not shown) so as to extend from the center of the two-legged base member at right angle with respect thereto, thereby forming a three-point movable support for the book holder. In a preferred embodiment, the stability of this stand is achieved by keeping the centroid of the mass of the book holder 100 horizontally 'inside" of the triangle described by the imaginary lines connecting the three casters. In the actual construction, the two-legged base member 201 is threadably secured to one side of a lower vertical post 207 of any known construction while the one-legged base member is threadably secured to the opposite side thereof. The lower vertical post 207 to which the single-legged and double-legged base members are threadably fastened is of essentially square cross section with a rectangular channel (not shown) extending over part of its length to accommodate the vertical part 210*a* of complementary shape of an upper vertical post 210, again of any known construction. The latter includes a further downwardly extending part 210*b* which, by means of a plug and bolt assembly 211 of any known construction, permits the upper post 210 to be fixed in any desired vertical position relative to the lower post 207. A lateral post 212 is rotatably supported in the upper vertical post member 210 and can be fixed in any angular position by means of a knob and bolt assembly 213 of any conventional construction. The lateral post 212, in turn, is slidably secured to the back plate 101. For that purpose, the lateral post 212 is provided at its free end with a slide mechanism of any known type (not shown). Rotating the lateral post 212 approximately 180° and then reconnecting the book holder 100 upright in this newly formed position allows the stand to be placed on either side of a bed, chair, table or article of furniture. In another known embodiment of a stand which can be used with this invention, the connection may include a hemispherically shaped connecting member (not shown) to permit universal pivotal movement of the book holder 100 relative to the support post.

The book holder generally designated by reference numeral 100 (FIGS. 1 and 2) includes a back plate 101 which is held in position by a stand and which holds two vertical frame members 102*a* and 102*b* of at least approximately U-shaped cross section whereby the back plate 101 is accommodated between the leg portions of each U of the frame members 102*a* and 102*b* and held in position by any conventional means, such as screws, glue or ultra-sonic welding (not shown). Support ledges of known configuration 103 are secured near the lower edge of the back plate 101, whereby the lower edges of a book cover or the first several and last several pages of a book are adapted to rest on these ledges 103. Ledges 103 can also be molded integrally with back plate 101. Additionally, known straps 104 suitably secured to the back side of the back plate 101 in any conventional manner such as by screws at the top and by hook-and-loop fasteners at the bottom, e.g. "Velcro" (not shown) serve to hold the cover of the book in place by attaching the straps onto the back of back plate 101. In lieu of straps 104, known strings or clips may also be used to hold the cover of the book against the back plate 101 and to hold the bottom of the book on the ledges 103, so long as the strings or clips are not positioned over the reading material. A cover member 106 of transparent material, preferably plexiglass, or injection-molded of polycarbonate, is supported along both sides thereof by vertical frame members 107*a* and 107*b* which again are of at least approximately U-shaped cross section, accommodating the plexiglass cover member 106 between the leg portions of each U whereby the cover plate 106 is also fixed in position within frame members 107*a* and 107*b* by any conventional means, such as screws, glue or ultra-sonic welding (not shown). Cover member 106 can also be injection-molded as one piece together with the vertical frame members 107*b* and 107*a* and possibly also co-injection molded or insert-molded with support arms 110. If cover member 106 is integral with vertical frame members 107*a* and 107*b*, the connections to the lateral support arms 110 can be by screws, glue or ultra-sonic welding. The back plate 101 may be of any suitable material such as wood, particle board, plastic, etc., and is secured to the vertical frame members 102*a* and 102*b* by any conventional means, such as screws, while the vertical frame members 102*a* and 102*b* may be made, for example, of injection-molded plastic parts. The length of vertical frame members 102*a* and 102*b* can be as shown or need only be as long as the vertical height of receiver plates 112. In the alternative, each vertical frame member 107*a* and 107*b* may also be made of wood, routed to form a substantially U-shaped channel-like configuration.

Figure 2:
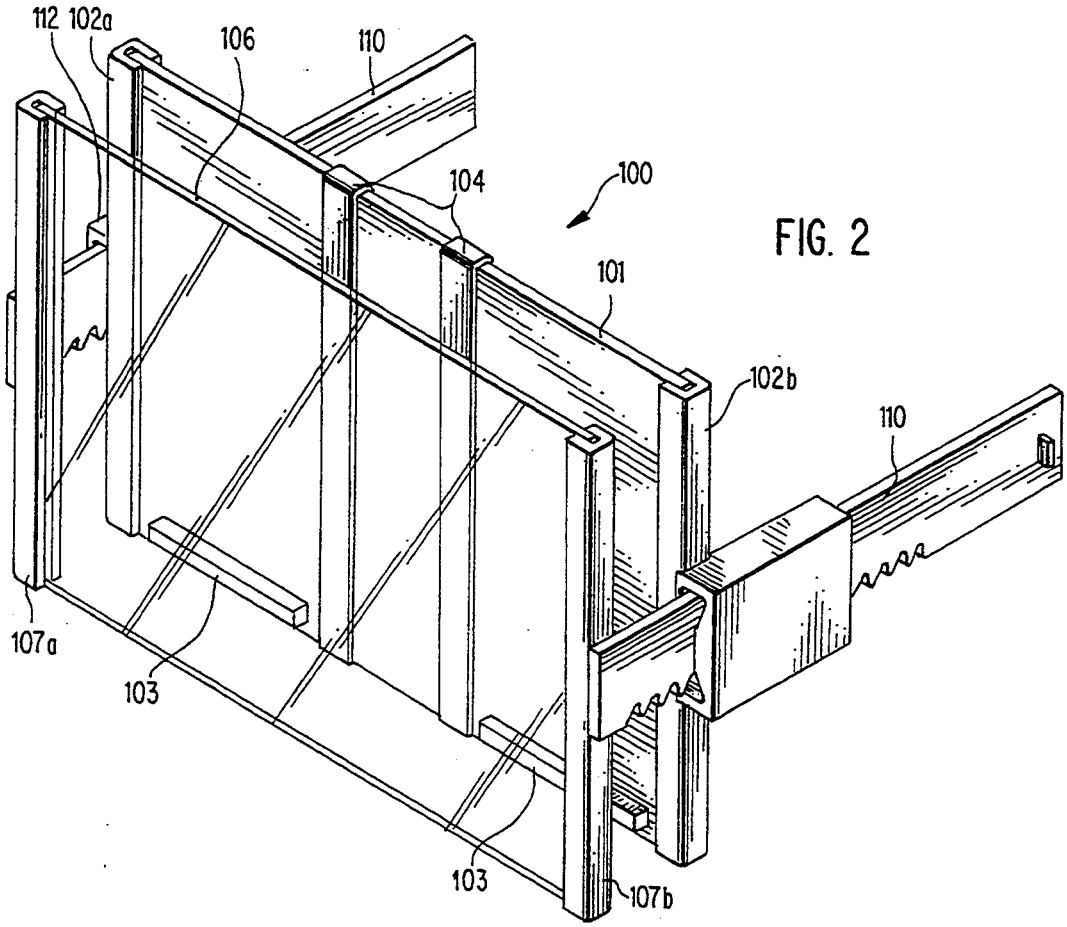
FIG. 2 is a somewhat schematic perspective view showing details of the book holder in accordance with the present invention.
Figure 3:
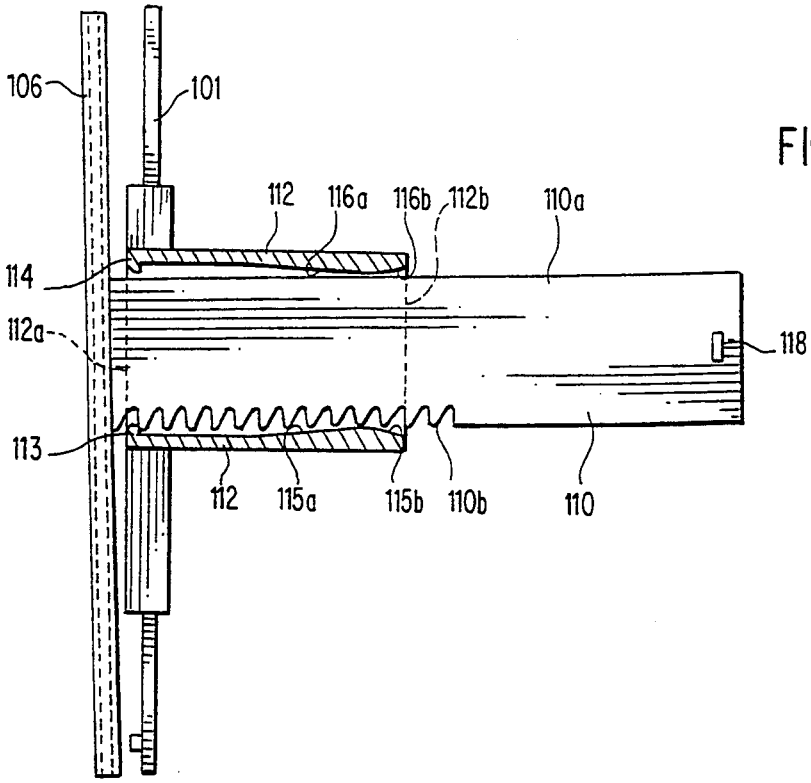
FIG. 3 is a somewhat schematic cross-sectional view through the receiver plate and illustrating the retracted position of the lateral support arm in the receiver plate in accordance with the present invention.
Figure 4:
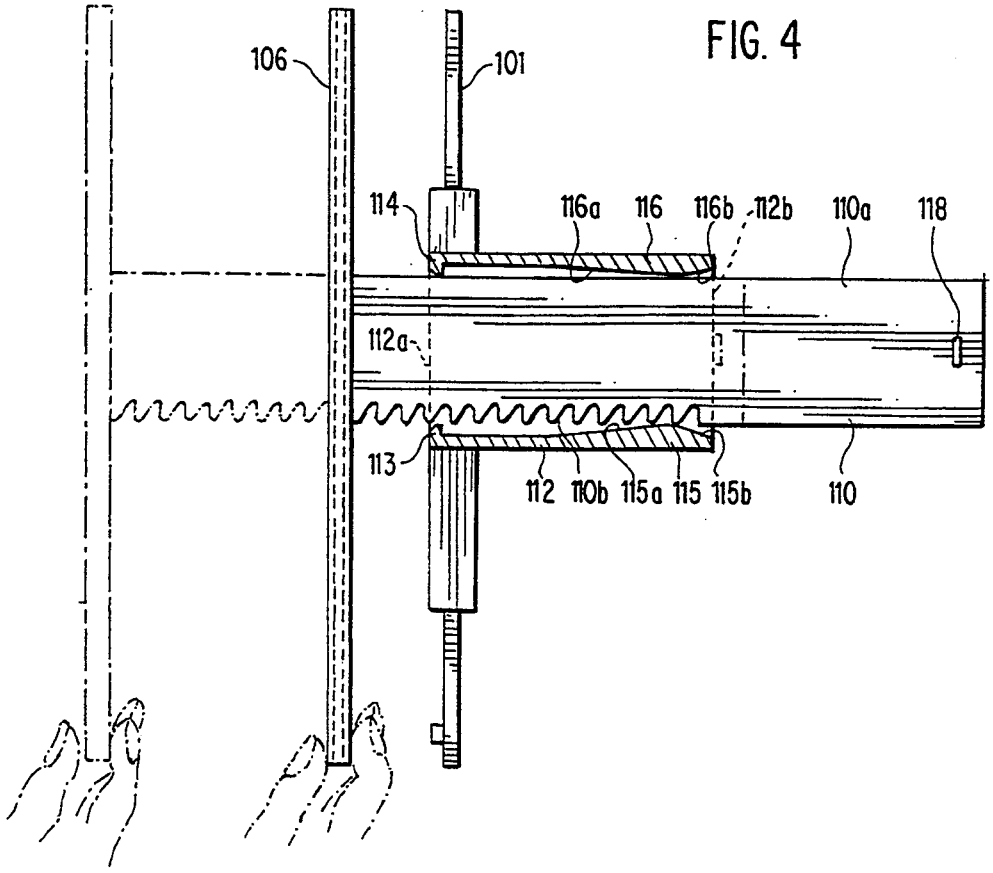
FIG. 4 is a somewhat schematic cross-sectional view, similar to FIG. 3, but showing the parts thereof in the extended or active positions.

Fixed relative to the sides of the frame members 102*a* and 102*b* are receiver plates 112 of hollow construction with an inlet opening 112*a* and an exit opening 112*b* (FIGS. 3 and 4). In the embodiment of FIGS. 2 through 4, the lateral support arms 110 are made of semi-flexible or relatively rigid material and are substantially rectilinear. The top surface 110*a* of the lateral support arms 110 is relatively smooth while the bottom edge is provided with a toothed profile 110*b*. Optional also is a lateral support arm with toothed profiles on both the top and bottom edges to be used on both sides of back plate 101 with countersunk screw fastening surfaces facing outward to allow one mold for reduced fixed manufacturing expense. A catch 113 in the bottom part of the inlet opening 112*a* of the receiver plate 112 is of complementary shape to the toothed profile so as to engage with same in the retracted position of cover plate 106, as illustrated in FIG. 3, yet enable sliding movement of the cover plate while retracting as illustrated in FIG. 4. The vertical stop 114 provided at the top side of the inlet opening 112*a*, which limits the lifting of the cover plate 106 and of support arms 110, is out of engagement with any lateral support arm surface while the lower catch 113 is engaged with teeth 110*b*. A relatively large, smooth cam area 115 and 116 is formed in the bottom and top surfaces of the receiver plate 112 at pre-disposed distances from the catches for purposes which will be described more fully hereinafter. Each cam surface is thereby formed by a slowly rising portion 115*a* and 116*a* in the direction from the beginning toward the peak of the camming surface 115 and 116 and by a more steeply descending camming surface 115*b* and 116*b*. However, the camming surfaces 115*a*, 115*b* and 116*a*, 116*b* may also have similar slants or radii of curvature. To reduce the complexity of the mold, the cam surfaces 115 and 116 may also be formed by plastic pads suitably fastened to the top and bottom surfaces of the receiver plates 112 as will be described more fully by reference to FIGS. 8 and 9. The geometry used in the cams only must avoid too much of a gradient against a tooth to permit smooth sliding action. A leaf-spring-like stop member 118 is provided near the free end of each lateral support arm 110 to limit the maximum movement of the cover plate 106 away from the back plate 101 and thereby limits the maximum throw to protect the user from facial injury in the unlikely event that the teeth become accidentally disengaged while reading. The leaf-spring-like shape of the stop member 118 facilitates active removal by the reader of lateral support arms 110 from receiver plates 112 for shipping and assembly. Other types of stops of known configuration, such as screws with nuts, can also facilitate a stopping action of the lateral support arms relative to the receiver plates. The teeth may also extend along the full length of lateral support arms 110 or be truncated to only include the first inch or two. This optional configuration allows positive catching to hold pages flat only in the retracted position while permitting the non-toothed section to slide freely for page-turning in the extended position. The preferred, more fully toothed configuration can accommodate certain readers who prefer to limit the amount of throw of the front plate during page turning.

In operation, while reading, the back face of catch 113 of the receiver plate 112 engages with the corresponding, approximately parallel front face of a tooth of the toothed profile 110*b* of the lateral support arm 110 to hold the plexiglass cover member 106 retracted and pressed against the pages of the book relative to and approximately co-planar with the back plate 101. As such, the back plate 101 can be left approximately vertical for reading in chairs or rotated nearly 90° for fully reclined reading in bed, without the reader's head being propped up by pillows. Any amount of rotation between these two positions is possible. FIG. 3 illustrates the position in which the catch 113 engages with the toothed profile, representing the retracted position of the parts.

When it is desired to turn a page, it is only necessary to grip with one or both hands the bottom area of the cover plate 106 as shown in FIG. 4 or the sides of the cover plate by way of vertical frame members 107*a* and 107*b* and lift the same whereby the catches 113 of the receiver plates 112 release the support arms 110, thereby allowing the plexiglass cover plate 106 to now be moved by the reader in a co-planar direction, away from the back plate (and book) and thus leaving, for example, enough space to place a hand (or hands) behind the plexiglass cover plate to allow page turning. (See extended position in FIG. 4.) This sliding action occurs when the plexiglass cover 106 is lifted above the height of the teeth 110*b* toward and away from the receiver plate 112, which is possible due to the smooth sliding fulcrum support at the cam area 115. The reader need not be concerned about carefully limiting the amount of effort or the distance required to lift the cover plate 106 because the vertical stop 114 automatically limits the reader's lifting action. The play between the top and bottom of the lateral support arm 110 and the receiver plate 112 can thereby be pre-selected as desired by the product designer. The lateral support arms 110 move in near unison on both sides of cover plate 106 due to the shear strength of the cover plate 106 material in this direction, and due to the control exerted by the reader in guiding this action. The reader can either extend the cover plate 106 to the full limit of its throw, which is determined by the longitudinal stops 118, can then turn the largely unrestricted pages of the book, or the user can abbreviate the motion by simply letting go of the cover 106 at which point the teeth **110*b* will engage with catches 113 to latch the cover in position. Page turning by the reader is also possible at an abbreviated point even though the ends of the page may hit the cover plate 106**. The latter approach works successfully when the entire unit is rotated nearly 90° for fully reclined reading in bed.

Retracting The Cover Plate

After the reader has used his or her hand or hands to turn a page behind the extended cover plate 106, and it is now desired to press the newly turned pages flat, the reader can now push the cover plate 106 in a direction that is essentially toward the back plate 101, which direction is perpendicular to the planar surface of the cover plate 106 and back plate 101. The inclined plane front configuration of the teeth **110*b* of the lateral support arms 110, in conjunction with the corresponding inclined plane front surface of the catches 113, allows a sliding-retracting movement of the assembled lateral support arms 110, vertical support members 107 and cover plate 106, without a significant additional effort supplied by the reader to lift the cover plate 106 in addition to pushing. Some small amount of lifting effort of the cover plate assembly, in addition to a primary sliding effort, may be supplied by the reader depending upon the pre-selected angles of both of the teeth 110*a* and front surfaces of the catches 113; the selected angle of the book holder 100 relative to any stand 200; the coefficients of friction of the materials of the lateral support arms 110 and catches 113; the effective weight of the moment arm generated by the assembled cover plate, including cover plate 106, vertical support members 107, lateral support arms 110 and their connecting fasteners (not shown); the overturning moment resistance of the book holder 100 and stand 200 (if unclamped); the rolling resistance of the casters 203 of the stand (if unlockable casters are used); the coefficient of friction of the wheel-surface of locked casters 203 (if used and if locked); and the coefficient of friction of the floor that the stand 200** is resting on (if unclamped).

At any point the reader desires, the action of retracting the cover plate 106 may be ceased, by letting go of the cover plate, at which point the moment generated by the mass which overhangs from the cams 115 and 116 causes a reaction force to be applied to the interface of the teeth **110*b* and catches 113, causing the two opposing inclined plane surfaces to slide until stopped by the engagement of the corresponding parallel opposing surfaces of both the teeth 100*b* and the catches 113, while at the same time the other toothed end of the lateral support arm 110 is free to seek this stopped position as controlled by the teeth 110*b* and catches 113 because of its smooth sliding interface between the teeth 110*b* and the cams 115 and 116**. Thus the cover plate assembly is stopped from extending outward until a vertical effort is supplied by the reader to the cover plate assembly. (The terms vertical and horizontal are applied relative to the face of the book holder.)

As embodied with the flexible version of the lateral support arms 110, the reader may need to add some degree of effort to control the amount of twist between the cover plate 106 and back plate 101 during the action of extending and retracting the cover plate 106. (Twist is a motion described about a vertical axis relative to the face of the book holder.)

In practice, the amount of retraction of the cover plate 106 relative to the back plate 101, and hence book, is arbitrarily, and is determined by the reader's own interpretation of how much the pages should be flattened in order to achieve good reading. The compression between the pages of the book and the cover plate 106 as well as the parallel opposing surfaces of the teeth **110*b* and catches 113 typically depends upon the thickness of the book and the corresponding curvature of the gutter section of the binding area of the book. Thick books or paperbacks may require significant compression. Thin books or valuable hard cover books can be read without significant compression between the pages and front plate and between the teeth 110*b* and catches 113. The degree of compression and the allowance for different thickness books is achieved by how far the lateral support arms 110, with their corresponding rows of incremental teeth 110*b*, are engaged with the catches 113 as determined by the reader. It should be noted that in some cases, depending upon the coefficient of friction of the pages of the book, and typically whether the pages are made of coated printing or of uncoated printing, the reader may have to hold the pages flat with one hand while the other hand facilitates retraction of the cover plate 106, in order to preclude frictional and static electricity resistance between the cover plate 106** and pages of the book.

The catches 113 and stops 114 can be integral with the receiver plates 112 or separate and attached directly to the back plate 101 as in conjunction with a unitary curved receiver plate, or the catches 113 and stops 114 can be connected to the vertical support members 102.

In summary, the reader operates the page-turning capability of the book holder 100 by lifting the cover plate 106 and then moving it away from the back plate 101 to a point that will allow enough space for a hand to be comfortably placed between the cover plate 106 and the now extended, loose pages of the book. One hand or two hands can be used to lift and move the cover plate 106. During the action of turning the page, the reader need not hold the cover plate 106 because the nearly parallel opposing surfaces of the teeth **110*b* and catches 113 prevent outward movement of the cover plate 106. Upon having turned the page, the reader can leave one hand, with the fingers spread open, holding the pages of the book flat, while the other hand pushes the cover plate 101 toward the back plate 106. As the pages become pressed by the reader's retraction of the cover plate 101, the other hand can be incrementally withdrawn from behind the cover plate 101. With books that are of uncoated paper stock, the reader's hand typically need not remain between the cover plate 106 and the pages of the book because the cover plate 106** itself will push the newly turned pages to a flat position.

Inserting And Removing The Book

To insert a book into the book holder 100, the cover plate 106 is extended away from the back plate 101, preferably while the book holder 100 is rotated slightly upward relative to the stand 200 so that the newly formed, "top" side of the back plate 101 is ready to hold the book without the assistance of any devices, except perhaps from the resistance of the support ledges 103. In this position of the book holder 100, the friction exerted between the inclined surfaces of both the teeth 110*b* and the catches 113 holds the cover plate assembly in an extended position. Being that the top ends of the straps 104 are pre-secured by screws or other suitable securing means to the top end of the back plate 101, the free ends of straps 104 are now secured by the reader over the insides of the cover of the book (or over the first and last several pages of a paperback) and then positioned around the bottom end and back of the back plate 101 and attached with pre-sewn, glued or ultrasonically welded hook and loop fasteners, like "Velcro" or the like, which are attached to the straps 104 and back plate 101. Both the pre-secured and reader-controlled ends of the straps can be reversed in alternative designs. Once the book is secured, the book holder 100 can be rotated to nearly any position, not the least of which includes downward positioning for reclined, ergonomic, heads-up reading.

In office use, the book holder can be placed above computer monitors (VDT's) with the book held in an almost vertical position so that the operator has more free desk space and so that the operator's head is more upright and ergonomic during long work sessions—which will reduce neck strain, enhancing productivity.

At least the inlet opening 112*a* and possibly also the exit opening 112*b* are of vertically turned bow-tie shape to allow only the non-worn, non-edged sections of the lateral support arm 110 to resist excess motion in the roll direction as indicated in FIG. 2. As the edges of the toothed profile 110*b* become distorted with use, smooth extending and retracting movement might otherwise be restricted without the bow-tie shape.

For purposes of manufacturing economies, the top and bottom inside profiles including the catches and the cams of the receiver plates 112 are thereby symmetrical in shape for use on the left and right sides of the book holder 100.

Figure 5:
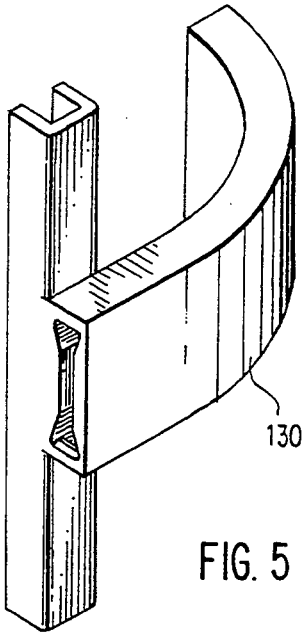
FIG. 5 is a partial somewhat schematic perspective view illustrating a modified embodiment of a curved receiver plate in accordance with the present invention.
Figure 6:
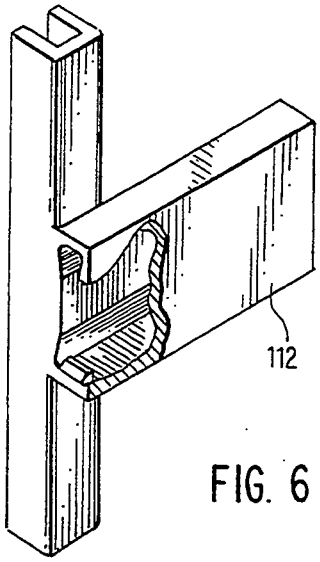
FIG. 6 is a partial perspective view, similar to FIG. 5, with parts broken away and illustrating details of the receiver plate thereof.

FIG. 5 illustrates a modified embodiment of a receiver plate 130 which is now of curvilinear configuration as shown. In that case, the support arm should be made of a relatively flexible material whereby the geometry (height and thickness) as well as the flex modulus of elasticity of the material are optimized to allow the conflicting requirements of curving around with the curved receiver plate, yet preclude buckling at full extension to hold the cover 106 where intended. In the embodiment of FIG. 5, the curve of the curved receiver plate 130 can begin at any point and the cam areas 115 and 116 inside the receiver plate 130 can be contained either within the straight section of the curved receiver plate or in the curved section thereof. The curved receiver plates 130 as shown in FIG. 5 may be embodied at two locations, one on each side of the back plate 101. However, they may also be embodied as one piece, wrapping completely around the back side of the entire back plate 101. If used in two locations, they may also be joined by a covering plate.

Additionally, the lateral support arms are again provided with suitable stops (not shown) which slide through openings in the curved receiver plate, if of one-piece construction, and which cooperate with internal stops.

Figure 8:
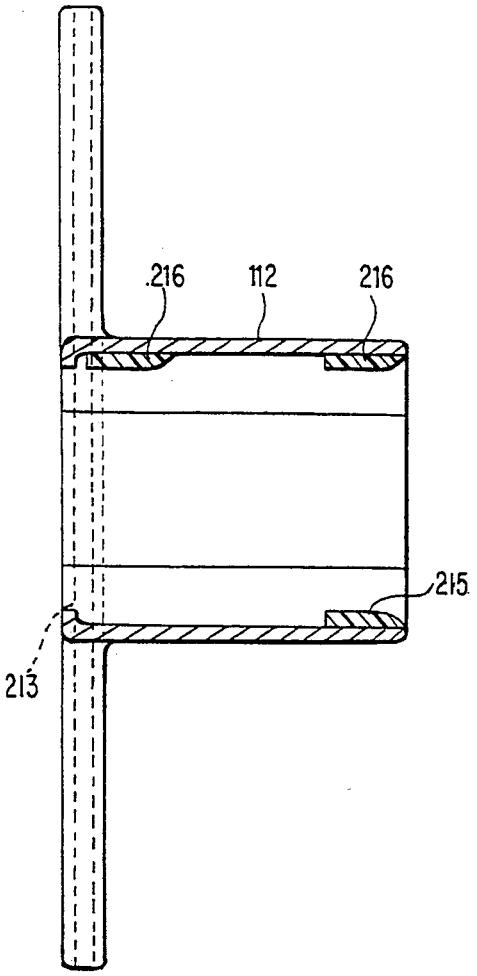
FIG. 8 is a somewhat schematic cross-sectional view of a modified embodiment of a receiver plate in accordance with the present invention in which plastic pads are used to provide cam surfaces.
Figure 9:
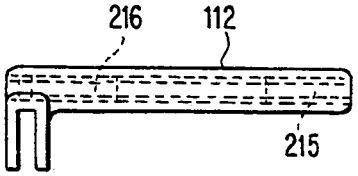
FIG. 9 is a bottom view on FIG. 8.

In the embodiment of FIGS. 8 and 9, two plastic pads 216 are provided in the top surface and a single pad 215 in the bottom surface of the receiver plate 112 to form the cam surfaces, whereby pads 216 deactivate the teeth on the top of the support arms 110 while the single pad 215 allows the teeth 110*b* to slip past the back corner but engage with lip 213 on the front corner. The pad 215 thereby also serves as fulcrum point to allow sliding movement when the front part of support arm 110 is lifted.

Figure 12:
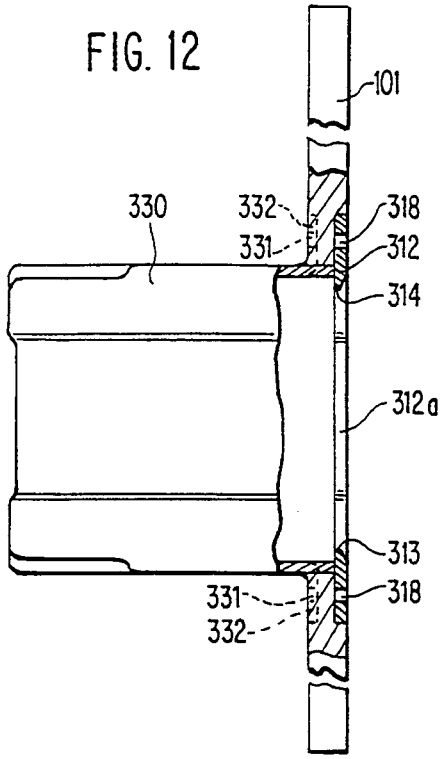
FIG. 12 is a left side elevational view of FIG. 10.
Figure 10:
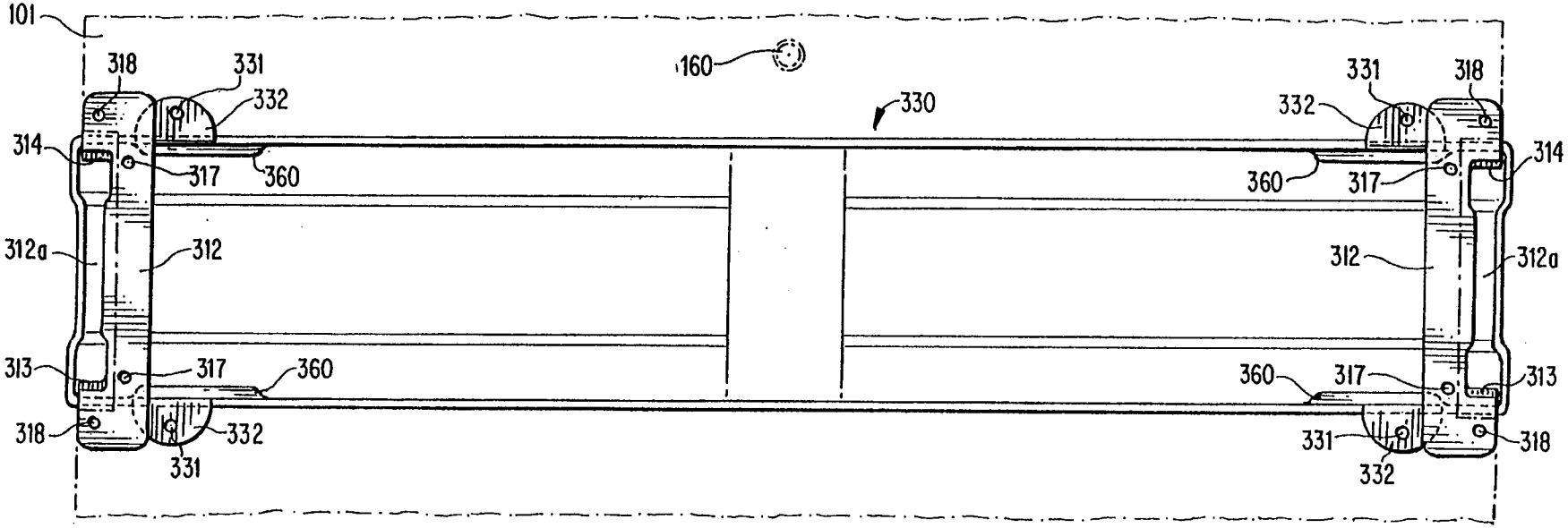
FIG. 10 is a front elevational view of another modified embodiment of a book holder in accordance with the present invention with a unitary curved receiver plate and a catch plate.
Figure 11:
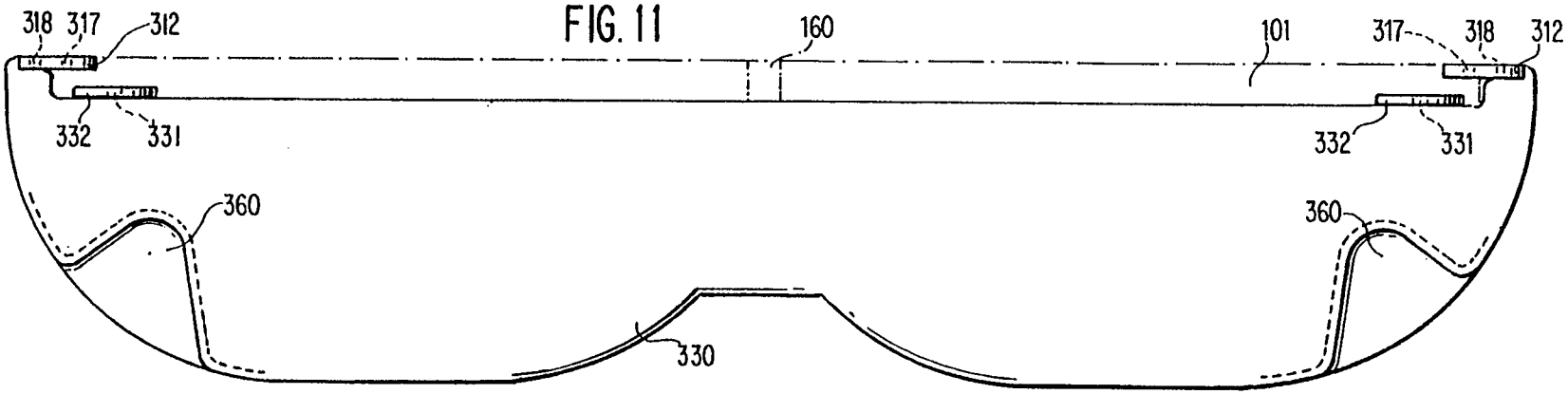
FIG. 11 is a bottom view of FIG. 10.

The embodiment of FIGS. 10 through 12 illustrates a further modified embodiment of a book holder in accordance with the present invention with a unitary curved receiver plate 330 which is attached to the back side of the back plate 101 by any suitable means, for example, by screws extending through holes 331 in lugs 332 of the receiver plate 330. A separate catch member 312 is provided on both sides of the back plate/receiver plate assembly and is secured to the back plate 101 (shown in phantom lines) by any suitable means, for example, by screws extending through holes 317 and 318. The features of the catch plate could be integral with the back plate, and the curved receiver plate would then be attached using suitable means, such as screws, sonic welding, glue, etc. The catch or lip 313 as also the stop 314 are formed in the catch member 312 which, together with the corresponding part of the unitary curved receiver plate form the bow-tie-shaped entry port 312*a*. The attachment to the frame or stand by way, for example, of the lateral post 212, is indicated at 160. Furthermore, the receiver plate 330 is provided with triangular cam-like members 360 for the assembly of posts (not shown) to keep the lateral support arms from rolling in the fully extended position, as will be explained by reference to the embodiment of FIGS. 14–16.

Figure 13:
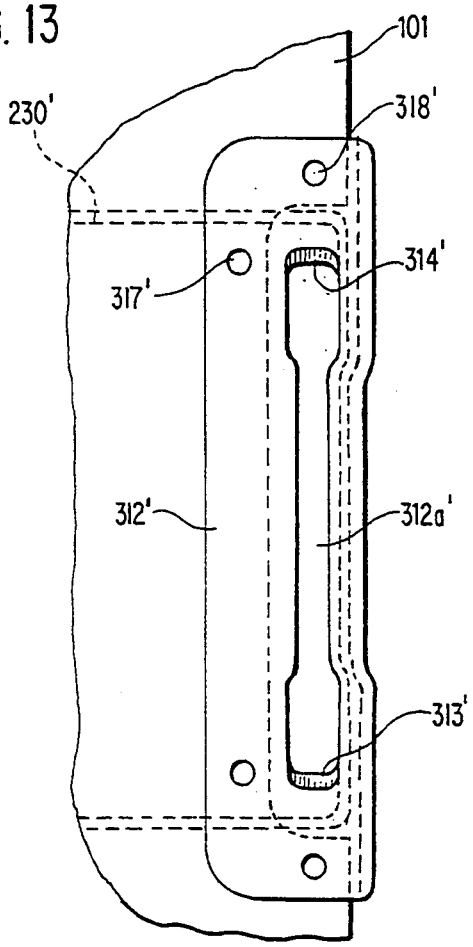
FIG. 13 is a partial elevational view illustrating a modified embodiment of a catch plate in accordance with the present invention.

FIG. 13, in which similar primed reference numerals are used as in FIGS. 10 through 12, illustrates a modified embodiment of a catch member 312' in which the bow-tie-shaped entry section 312*a'* is formed entirely by the catch plate. As to the rest, what was said with respect to the embodiment of FIGS. 10 through 12 applies to the embodiment of FIG. 13.

Figure 14:
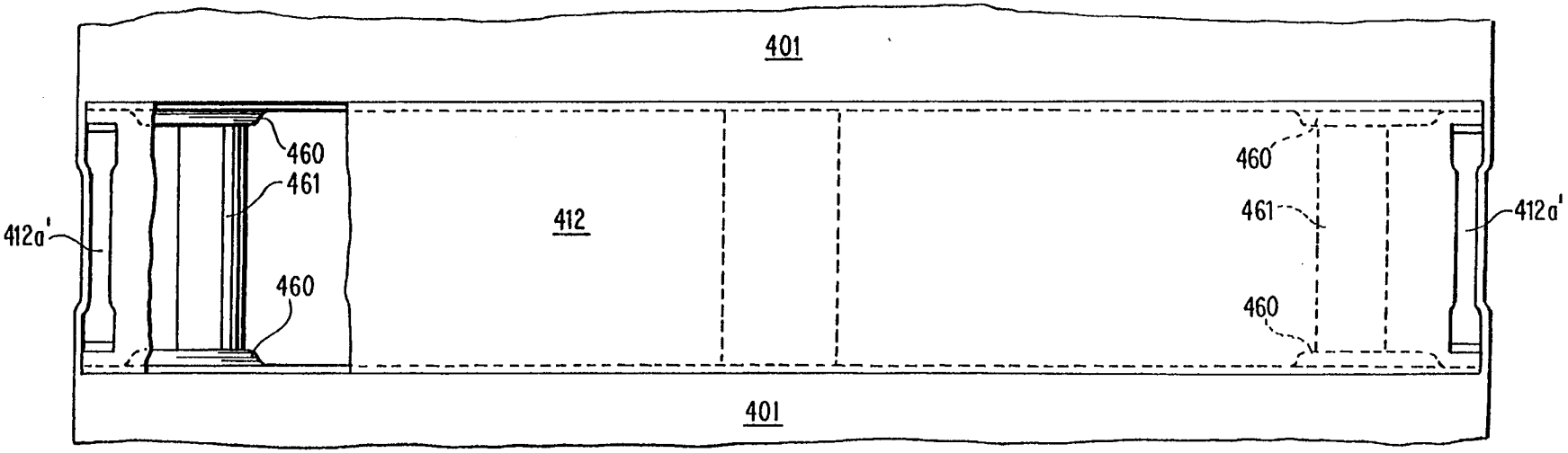
FIGS. 14–16 are, respectively, front elevational, top and right side elevational views of still another modified embodiment of a book holder in accordance with this invention with a unitary back plate/receiver plate arrangement.
Figure 15:
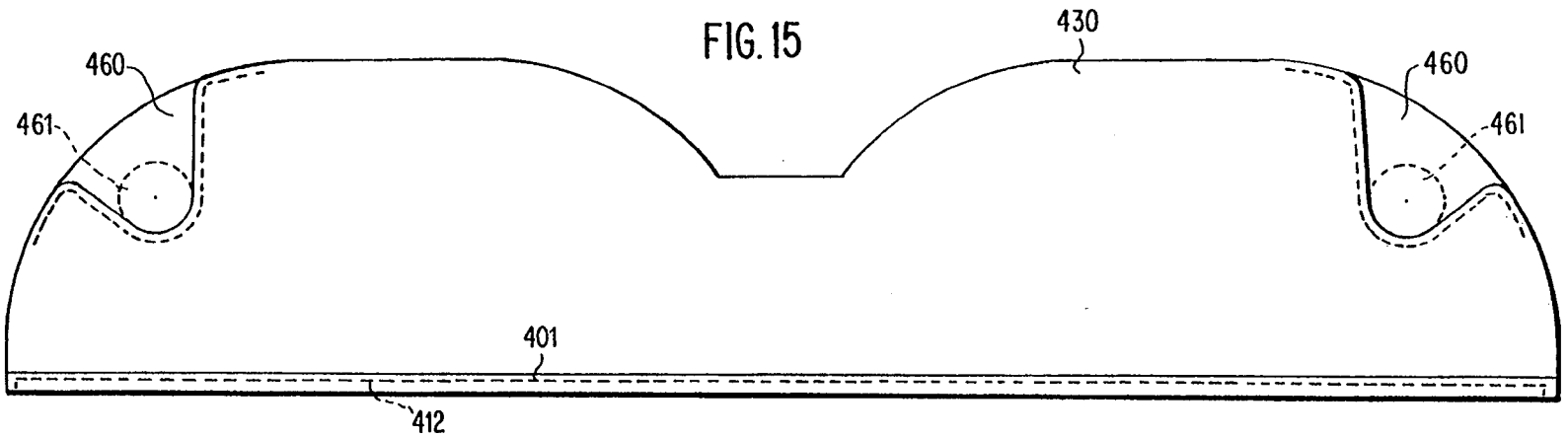
Figure 16:
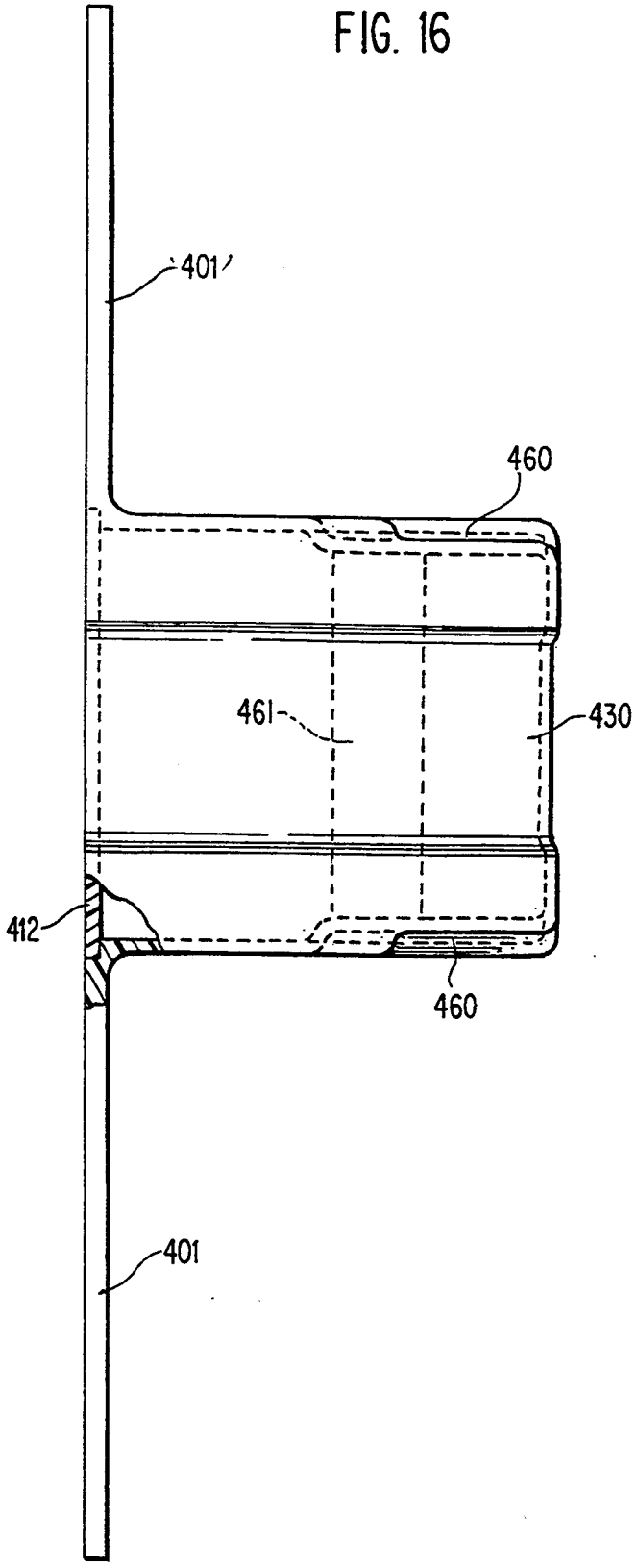

FIGS. 14–16 illustrate still another modified embodiment of a book holder in accordance with the present invention in which the back plate 401 is made in one piece with the receiver plate 430. Two posts 461 are provided between the cam-like members 460 inside the curved sections of the curved receiver plate 430 to keep the lateral support arms from rolling and hence buckling when extended. In this embodiment, the curved receiver plate 430 is combined integrally with the back plate 401 for unit cost reduction. The catch plate 412, which extends now over the entire width of the back plate, may form the entry section as disclosed in the embodiment of FIGS. 10 through 12 or preferably provides a one-piece entry port 412*a'* that gives geometric definition to the entry sections of the receiver structure as described in connection with FIG. 13. The separation of the entry section 412*a'* from the curved receiver section also permits a cost reduction.

The separate catch plate of FIGS. 14 through 16 could be attached only to the back plate or only to the curved receiver plate which in turn is then attached to the back plate. However, by connecting the catch plate to both the back plate and the receiver plate, rigidity of the catch area is enhanced so that the durability of this region is maximized.

The book holder according to the present invention achieves some important objectives. It permits an ergonomic body position for reading when the book is positioned at or above the eye level. Reader muscle fatigue (and muscle activity as measured by EMG equipment) is reduced when the head is supported in the upright or reclined positions. It facilitates easy page turning when the book is held open for reading to accommodate the above requirements. The book holder is modularly adaptable to a variety of support frames, for use at home, in commercial kitchens, in the office, in hospitals or even on the floor. Unlike some of the prior art, no part of the book holder in accordance with the present invention blocks visual contact with the reading material.

There are no truncated, transparent page-holding sections, which cause eye strain by reading over the edges of these sections.

Additionally, the transparent plexiglass cover 106 can be moved approximately planar to the reading material of the book which is typically perpendicular to the face of the reader so that no one surface of the cover moves closer to the user's face than any other surface, thereby enhancing the safety of the reader. The plexiglass cover 106 is supported from the center of the sides so that the user's hands, when turning the pages, can do so unrestricted from the most readily accessed points, the bottom and the lower sides of the book holder 100.

The book holder in accordance with the present invention permits hands-free reading, thereby permitting concentrating on the reading material rather than on holding the book, which can be held in nearly any position, even with the book facing nearly fully downward. The reader's hands can also be free to take notes. This unique book holder permits comfortable, ergonomic positions of the reader's body. Although page turning may take the reader slightly longer when compared to unassisted, hand-held reading, the net ergonomic benefit can be greater with the device of this invention due to the allowance of a fully reclined, head-supported body position. The book holder and its several optional types of stands permit use thereof at almost any chair, bed, desk or kitchen counter. Additionally, if the parts of the stand described herein are made of wood, such as ash wood with black components and brass screws, the assembly in accordance with the present invention represents a handsome article of furniture which is easy to assemble and disassemble, is compact, light-weight and durable.

While I have shown and described several embodiments in accordance with the present invention, it is understood that the same is not limited thereto but is susceptible of numerous changes and modifications as known to those skilled in the art. For example, the basic box structure of the receiver plate can be attached directly to the back plate without the vertical extensions or could even be constructed in one piece with the back plate. The lateral support arms can be joined to the plexiglass cover plate as shown or can be joined directly to the front plate without the vertical frame members. The plexiglass cover can be molded with thickened sectional geometry that will facilitate easy attachment of the lateral support arms. Furthermore, the lateral support arms can also be made in one piece with the cover plate by the use of one optimized material or co-injected or insert-molded in more than one material. With the use of plastic materials, sonic welding may also be used to attach the parts. Materials that could be used, for example, include a Nylon/ABS alloy, such as Monsanto Triax 1120, as also appropriate high-wear-resistant polypropylene may be used for the curved receiver plate in the embodiment of FIG. 5, while a Nylon 12, such as Atochem Rilsan AMVBLP 40 with a flex modulus of elasticity greater than approximately $8\times10^4$ psi may be used for the lateral support arms 110 in the embodiment of FIG. 2. The lateral support arms used in conjunction with the various types of curved receiver plates should have a lower flex modulus of elasticity, ranging, but not limited to, approximately $5\times10^4$ to $7.5\times10^4$ psi. A bent profile of the cover plate 104 along its lower edge or an added handle may also be added to the cover plate to facilitate an ergonomic finger hold.

The features of the catch plate could be integral with the back plate, and the curved receiver plate would then be attached using suitable means, such as screws, sonic welding, glue, etc.

The book holder 100 can be attached not only to the frame or stand 200 by way of the back plate 101 but also by way of the unitary curved receiver plate to which the lateral post may be connected in any known manner. The cam surfaces on the top side of the receiver plate, especially of the unitary curved receiver plate, may also be optional because the device of this invention also works fairly well without any cam surfaces 116 or 216 on the top side of the receiver plates. This will permit a reduction in manufacturing costs with acceptable loss of benefits of these cam surfaces.

Thus, I do not wish to be limited to the details shown and described herein but intend to cover all such changes and modifications as are known to those skilled in the art.

I claim:

1. A book holder comprising back plate means, unitary transparent cover plate means substantially coextensive with and movable relative to the back plate means, and means movably connecting the cover plate means with said back plate means to provide movement of said cover plate means toward and away from said back plate means in substantially co-planar relationship including two lateral support arm means fixed relative to said cover plate means and hollow receiver plate means fixed relative to said back plate means, said hollow receiver plate means being of such internal configuration as to enable said lateral support arm means to slide therethrough to thereby change the spacing between said back plate means and said cover plate means.

2. A book holder according to claim 1, further comprising ledge means on said back plate means to rest thereon parts of a book, and strap-like means for holding both book covers onto the back plate means.

3. A book holder according to claim 1, wherein said lateral support arm means are provided with toothed means, and wherein said receiver plate means are operable to catch the toothed means to hold the cover plate means against pages of a book to be read.

4. A book holder according to claim 3, wherein said receiver plate means are provided internally with camming surface means along the top and bottom thereof and with catch means at the inlet openings thereof operable to engage with said toothed means of the lateral support arm means.

5. A book holder according to claim 4, wherein said catch means are of a shape complementary to the shape of the tooth profile of the toothed means.

6. A book holder according to claim 3, wherein said receiver plate means are provided internally with camming surface means along the bottom thereof and with catch means at the inlet openings thereof operable to engage with said toothed means of the lateral support arm means.

7. A stand for a book holder according to claim 1, comprising base means, upright post means supported on said base means including a lower post member, an upper post member movable relative to the lower post member, and means for adjustably fixing said upper post member in predetermined position relative to the lower post member for height adjustment of the book holder, lateral post means rotatably secured to the upper area of the upper post member, and connecting means at the free end of the lateral post means to enable connection of the stand to the book holder.

8. A stand for a book holder according to claim 7, wherein said last-mentioned connecting means enable universal movement of the book holder relative to the stand.

9. A stand for a book holder according to claim 7, wherein said base means includes a two-legged base member and a one-legged base member secured to said two-legged base member in its center area and extending therefrom at an at least approximately right angle.

10. A stand for a book holder according to claim 9, wherein a caster is secured to a respective one of the free ends of the two-legged and one-legged base member by way of caster support members.

11. A stand with a base member for a book holder according to claim 1, further comprising means for preventing splitting of the part of the base member made from wood which is disposed below its horizontal bore including a threaded member screwed into said part from the bottom face of the base member at substantially right angle to said horizontal bore.

12. The combination according to claim 11, wherein the base member includes caster support members, wherein said caster support members are substantially L-shaped, having each a short and a long leg portion, and wherein a caster is secured to each shorter leg portion while the longer leg portion is secured in a substantially horizontal bore in the free end of the corresponding base member.

13. A book holder according to claim 1, wherein an inlet section for each of the support arm means is provided in the end area of the receiver plate means facing the cover plate means, and further comprising catch plate means fixed relative to said receiver plate means and forming at least in part said inlet section.

14. A book holder according to claim 13, wherein each inlet section is formed in its entirety by said catch means.

15. A book holder according to claim 14, wherein the receiver plate means is curved extending in one piece around the back side of the base plate means.

16. A book holder according to claim 15, wherein said back plate means and said receiver plate means are a one-piece structure.

17. A book older according to claim 16, wherein each inlet section is formed in its entirety by said catch means.

18. A book holder according to claim 15, wherein said catch plate means is fixed to at least one of back plate means and receiver plate means.

19. A book holder according to claim 18, wherein said catch plate means includes a separate catch plate member on each side of the back plate means.

20. A book holder according to claim 18, wherein said catch plate means is a unitary member extending over the width of the back plate means and includes means on each side to form at least in part said inlet section.

21. A book holder comprising back plate means, unitary transparent cover plate means substantially coextensive with and movable relative to the back plate means, and means movably connecting the cover plate means with said back plate means to provide movement of said cover plate means toward and away from said back plate means in substantially co-planar relationship including two lateral support arm means fixed relative to said cover plate means and hollow receiver plate means fixed relative to said back plate means, said hollow receiver plate means being of such internal configuration as to enable said lateral support arm means to slide therethrough, and complementary means in said receiver plate means and on said lateral support arm means for automatically holding said lateral support arm means in preselected positions by the weight of said cover plate means.

22. A book holder according to claim 21, wherein said complementary means include toothed profile means along the bottom edge of the lateral support arm means, and catch means of a shape complementary to the tooth profile for sliding engagement with said toothed profile means in one direction and catching engagement in the other direction, said catch means extending upwardly from said hollow receiver plate means within the area of the inlet openings thereof.

23. A book holder according to claim 22, wherein each receiver plate means includes camming surface means at least at the bottom of the hollow receiver plate means, said camming surface means having its maximum camming height spaced from the inlet opening and being so arranged that a pivot movement of the lateral support arm means is possible about the fulcrum of the camming surface means when the cover plate means is lifted and the camming surface means being shaped to enable sliding movement of the toothed support arm toward and away from the back plate means upon completion of the fulcruming movement.

24. A book holder according to claim 23, wherein each receiver plate means is provided with a stop member downwardly projecting from the top thereof within its inlet area and operable to engage with the top surface of the lateral support arm means which is smooth.

25. A book holder according to claim 23, wherein said lateral support arm means and said receiver plate means are substantially rectilinear and throw-limiting stop means near the free ends of the lateral support arm means.

26. A book holder according to claim 23, wherein said receiver plate means are at least part curvilinear extending to the rear of the back plate means, and wherein said lateral support arm means are of a material sufficiently flexible to follow the curvilinear shape of the receiver plate means.

27. A book holder according to claim 26, wherein said receiver plate means extend over the entire width of the back plate means and form in effect a unitary structure, and wherein said lateral support arm means are made from a flexible material.

28. A book holder according to claim 27, further comprising throw-limiting stop means on the lateral support arm means which are operable to engage with abutment means on the receiver plate means.

29. A book holder according to claim 21, wherein said lateral support arm means and said receiver plate means are substantially rectilinear and throw-limiting stop means near the free ends of the lateral support arm means.

30. A book holder according to claim 21, wherein said receiver plate means are at least part curvilinear extending to the rear of the back plate means, and wherein said lateral support arm means are of a material sufficiently flexible to follow the curvilinear shape of the receiver plate means.

31. A book holder according to claim 30, wherein said receiver plate means extend over the entire width of the book plate means and form in effect a unitary structure.

32. A book holder according to claim 31, further comprising throw-limiting stop means on the lateral support arm means which are operable to engage with internal abutment means within the inlet areas of the receiver plate means.

33. A base for an article of furniture, comprising a number of base members, and a caster support member for supporting thereon a caster and secured to a respective free end of the base members, said caster support members being substantially L-shaped, having each a shorter and longer leg portion, the shorter leg portion serving for supporting thereon a caster while the longer leg portion is secured in a substantially horizontal bore in the free end of the corresponding base member, and means for preventing splitting of the part of the corresponding base member made from wood which is located below its horizontal bore wile at the same time axially securing said longer leg portion within said horizontal bore including a threaded member screwed into said part of the corresponding base member from the bottom face thereof at substantially right angle to said horizontal bore and extending through a corresponding bore in the longer leg portion.

34. A base structure according to claim 33, which includes a two-legged base member and a one-legged base member secured to said two-legged base member in its center area and extending therefrom at an at least approximately right angle to provide a three caster support.

35. A base structure according o claim 33, wherein a caster is secured to a respective one of the free ends of the two-legged and one-legged base member by way of the shorter leg portion of the caster support members.

* * * * *